United States Patent [19]

Chitnis et al.

[11] 4,266,775

[45] May 12, 1981

[54] GAME INVOLVING THE DEALING IN COMMODITIES

[76] Inventors: Raveendra V. Chitnis; Hema R. Chitnis, both of 2424 Courtly Dr., Fostoria, Ohio 44830

[21] Appl. No.: 96,506

[22] Filed: Nov. 21, 1979

[51] Int. Cl.[3] ..... A63F 3/00

[52] U.S. Cl. ..... 273/278; 273/272

[58] Field of Search ..... 273/278, 277, 279, 256, 273/297

[56] References Cited

U.S. PATENT DOCUMENTS

| | | | |
|---|---|---|---|
| 590,078 | 9/1897 | Turner | 273/278 |
| 599,025 | 2/1898 | Sturges et al. | 273/278 |
| 1,132,403 | 3/1915 | Still | 273/278 |
| 1,760,287 | 5/1930 | Schippers | 273/278 |
| 2,571,403 | 10/1951 | Aird | 273/256 |
| 3,770,277 | 11/1973 | Cass | 273/278 |

*Primary Examiner*—Richard C. Pinkham
*Assistant Examiner*—Scott L. Brown
*Attorney, Agent, or Firm*—Wilson, Fraser, Barker & Clemens

[57] ABSTRACT

A game of commodity trading having a world map with a plurality of circles and disks placed on the circles corresponding to different commodities. A command die, a quantity die, a commodity die and a market price setting spinner are used in play of the game. The players start by rolling the commodity die, picking a corresponding disk and buying a corresponding commodity until all disks are gone. The disks have letters on them and the players form words from the disks. The market price spinner is then used to set the market price for the commodities. The players then throw the three dice and follow the dice directions. The winner is the player with the most money at the end of the predetermined time.

6 Claims, 8 Drawing Figures

GAME INVOLVING THE DEALING IN COMMODITIES

SUMMARY OF THE INVENTION

The invention relates to a game for several players competing individually. It pertains to the buying and selling of commodities and to some extent can be regarded as educational.

The game involves the purchase of several commodities as required by the rolling of a particular die. Purchases proceed successively from player to player until all commodities have been purchased. The number of commodity units to be purchased is determined in this step and the players buy accordingly at the face price of each commodity.

The game proceeds by determining the market price of each commodity, by the spin of a wheel. Then three dice are thrown at a time by the players successively. One die is the command die, which directs the player to buy or sell a certain commodity, or to pay a tax or receive a certain amount from the Treasury as tax return. The selling can take place by auction. The second or commodity die determines the particular commodity involved in the transaction. The third die, called the quantity die, designates the number of units of that deal. If the tax or tax return commands come up on the command die, then the commodity die is ignored.

DESCRIPTION OF THE PREFERRED EMBODIMENT

INTRODUCTION

The game is called "FLUKE!" and the object is to accumulate wealth from the sale of the several commodities. The player who has made the maximum amount of money at the end of the playing period is the winner. In the first instance, the players explore all over the world, as exemplified by the game board, for the different selected commodities. After acquiring the commodities, the players enter the world market with the aim of making money. Two people can play the game, but it is preferable that a greater number participate.

GAME BOARD, SPIN WHEEL AND PIECES USED IN GAME

A game board 10 has depicted the world on which are arranged thirty-six circles 11 in different areas where the commodities involved are obtainable. On each circle is a character 12, and in this instance, each character is from the word FLUKE!, the name of the game. The letters are arranged to read "FLUKE!" if read in a particular sequence, uniquely different for each set of six circles.

Figure 3:
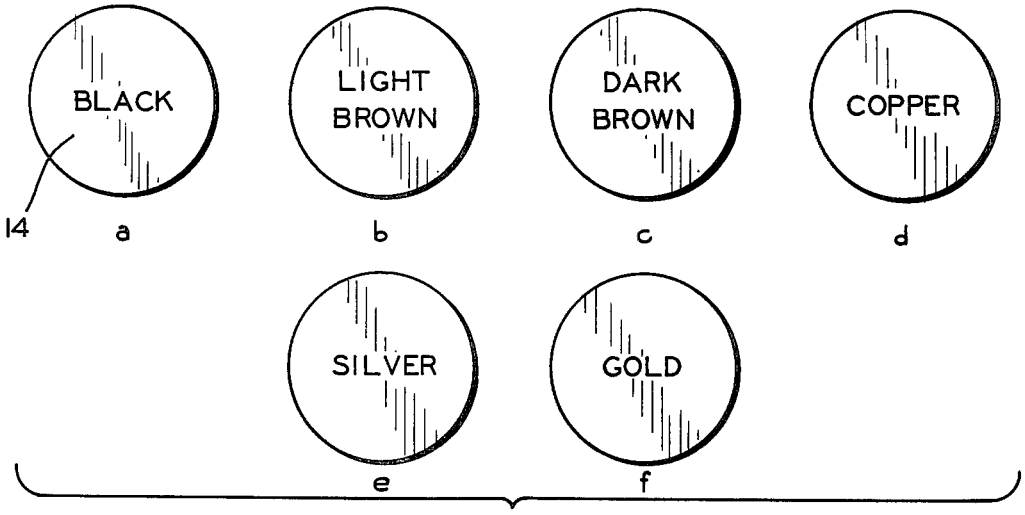
FIG. 3 is a top face view of the several disks which are placed on the game board and are color-coded as indicated.
Figure 4:
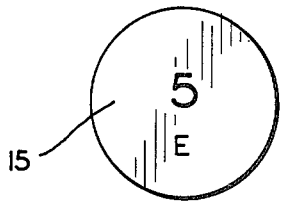
FIG. 4 is a bottom view of one of the disks showing that each contains one character of the word "FLUKE!" and in this instance, a number.

Initially thirty-six disks 14 of cardboard or any suitable material and of about the size of the circles 11 are placed randomly upon the circles 11. These disks are in sets of six. Each set is color-coded. As indicated in FIG. 3, one set "a" has its upper face colored black to represent the commodity oil. Set "b" is colored light brown to represent timber. Set "c" is colored dark brown to represent coffee. Set "d" is colored copper to represent copper. Set "e" is colored silver to represent silver. Set "f" is colored gold to represent gold. The underside of each disk 14 bears one character of the word "FLUKE!" and only three disks 14 of each set of six bear a number, which is 5, 3 or 2.

Figure 6:
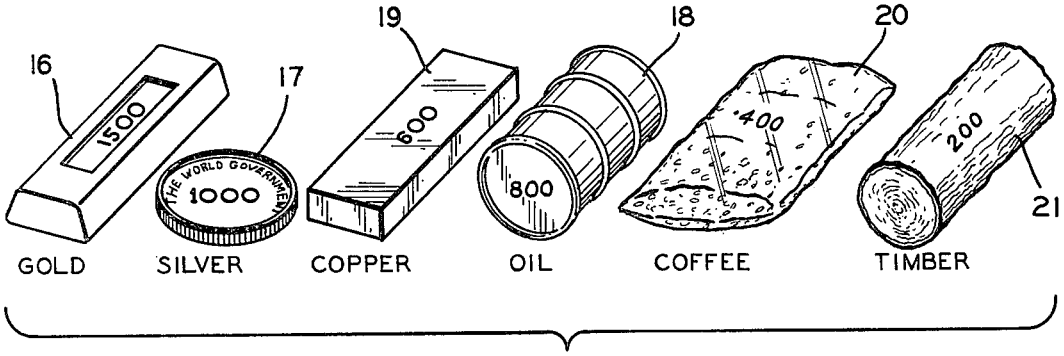
FIG. 6 is a bracketed perspective view of the several playing units or pieces representing the commodities gold, silver, copper, oil, coffee and timber.

Commodity units or pieces used in the game are shown in FIG. 6. There are ten units for each commodity. These commodities are represented as follows: a small bullion-shaped block 16 for gold showing a face price of $1500; a coin-like disk 17 for silver with a face price of $1000; a barrel-like cylinder 18 for oil bearing a face price of $800; a small rectangular block 19 for copper bearing the face price of $600; a small bag 20 formed of a transparent plastic material containing a few dark grains to represent coffee beans bearing a face price of $400; and a cylinder 21 for timber bearing the face price of $200 .

Figure 1:
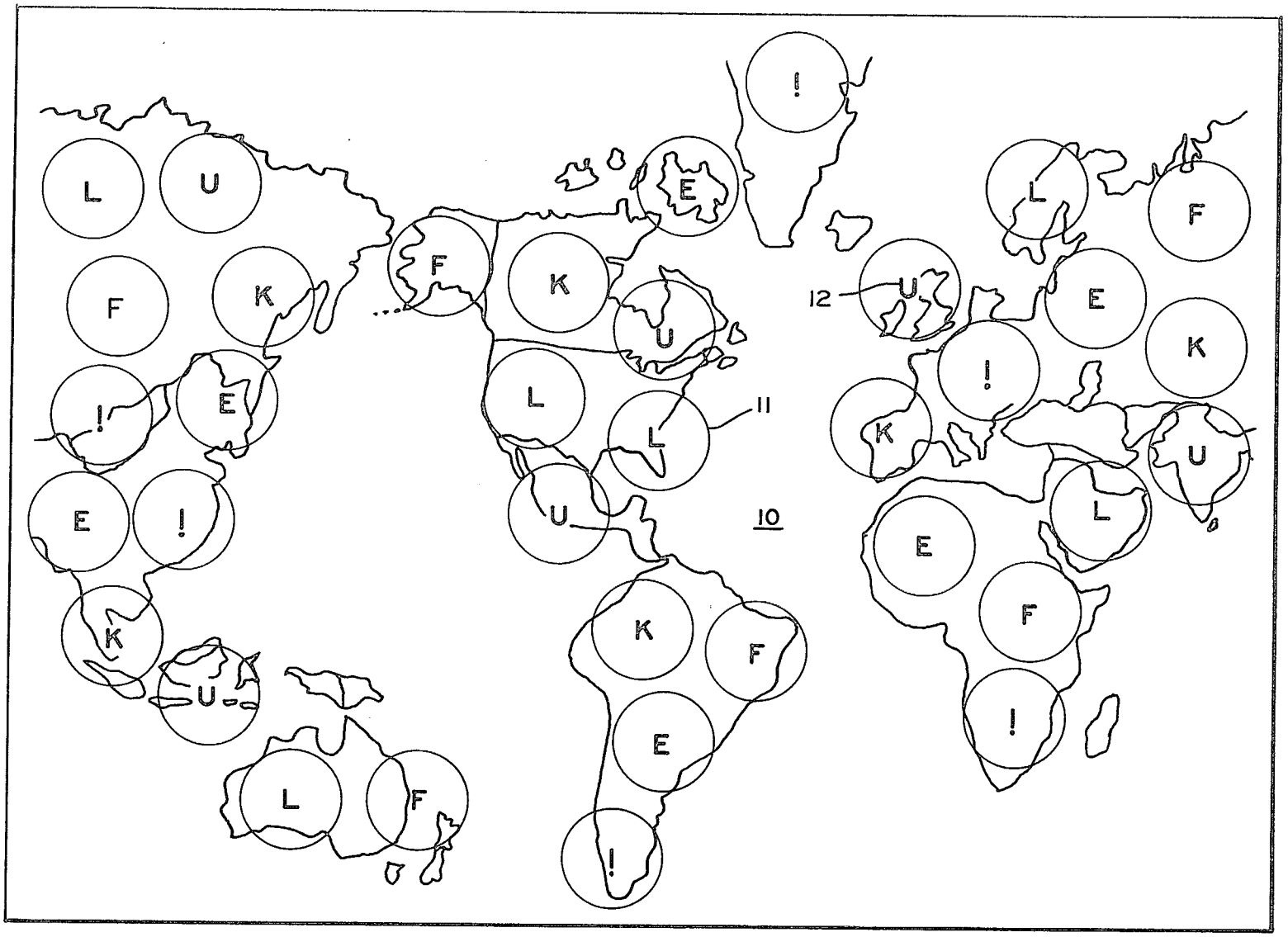
FIG. 1 is a plan view of the game board showing a map of the world and circles on which disks are placed during the course of the game.
Figure 2:
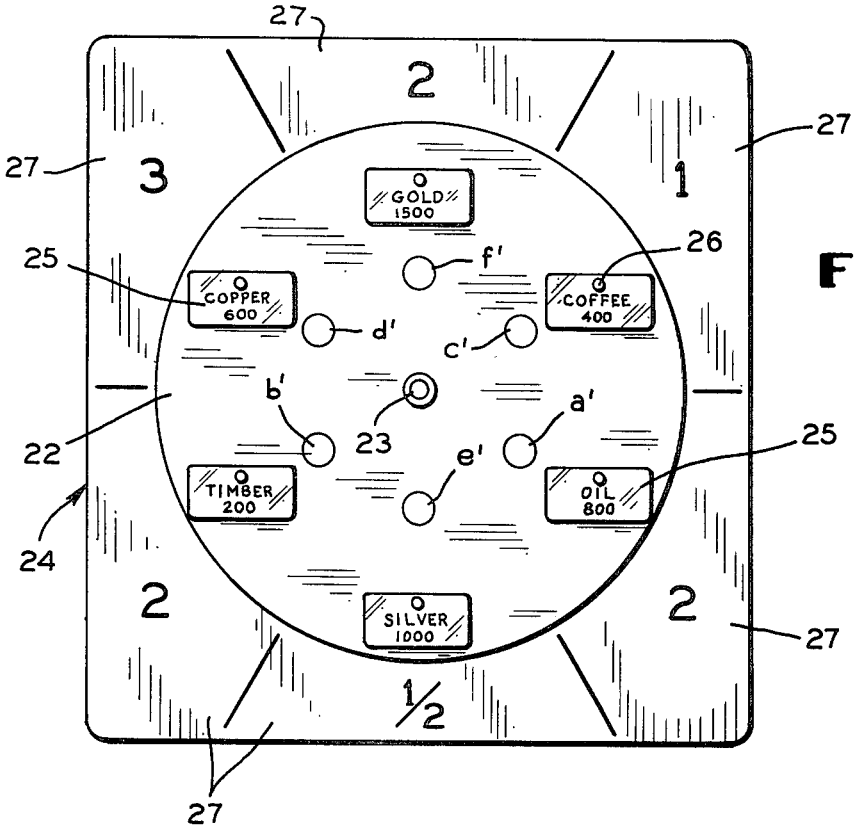
FIG. 2 is a face elevation of the spin wheel, known as the Fluke Wheel.

A spin wheel 22 or "FLUKE WHEEL", as it is called, is shown in FIG. 2, and has a central axle 23 securing it to a stationary back plate 24. For convenience, the plate 24 may be vertically inclined so as to be readily viewed by all players. On the wheel 22 are six equidistantly spaced labels 25 near the rim bearing the names and prices respectively of the above commodities. Each label 25 has a center pivot 26. Thus, if the plate 24 is upright, the labels 25 will always orient themselves in the horizontal position, thus enabling players to read them easily. Adjacent to each label a color-coded circle designated by a′ or b′ etc. in FIG. 2 is drawn on the wheel 22 to symbolize the particular commodity listed in that label.

The back plate 24 outside of the wheel 22 is separated into six equal sections 27 bearing in sequence the numerals 1, 2, ½, 2, 3 and 2 referred to as "Price Indices". As will hereinafter appear, when the wheel 22 comes to rest after being spun, the market price of any commodity adjacent to a particular section is obtained by multiplying the face price of the commodity by the Price Index shown on the wheel 22.

Figure 5:
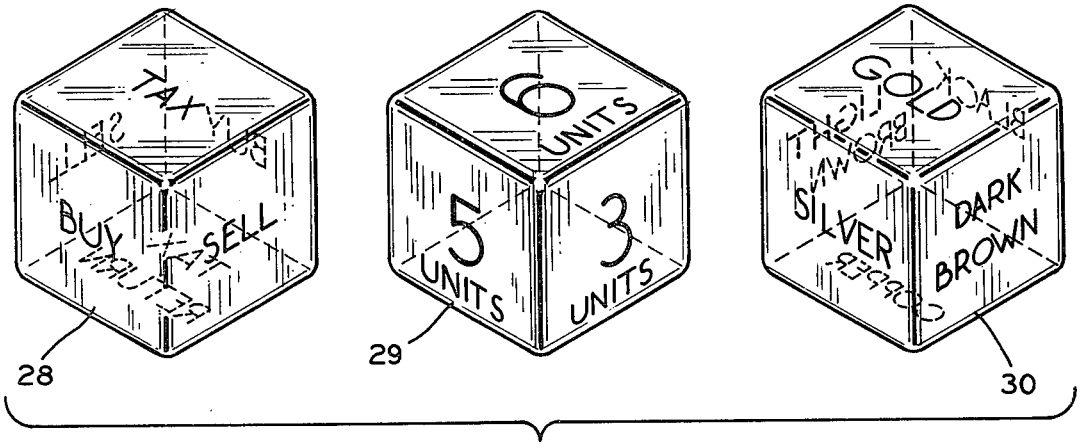
FIG. 5 is a bracketed perspective view on an enlarged scale of each of the command die, the quantity die, and the commodity die.

Three dice as indicated in FIG. 5 are used. One die 28 is called the "COMMAND DIE" and has on its faces the word "BUY" on its two faces, the word "SELL" on other two faces and "TAX" and "TAX RETURN" on each of the remaining two faces. Thus, upon the throw of this die the player must buy, sell, pay tax or will receive a refund from the Treasury.

A second die 29 is called the "QUANTITY DIE" having the indicia "1 UNIT", "2 UNITS", . . . all the way through "UNITS" marked respectively on each of its faces.

The third die 30 is called the "COMMODITY DIE" and has the colors gold, silver, black, light brown, copper and dark brown on the respective side to designate gold, silver, oil, timber, copper and coffee, the commodities around which the game centers.

Figure 7:
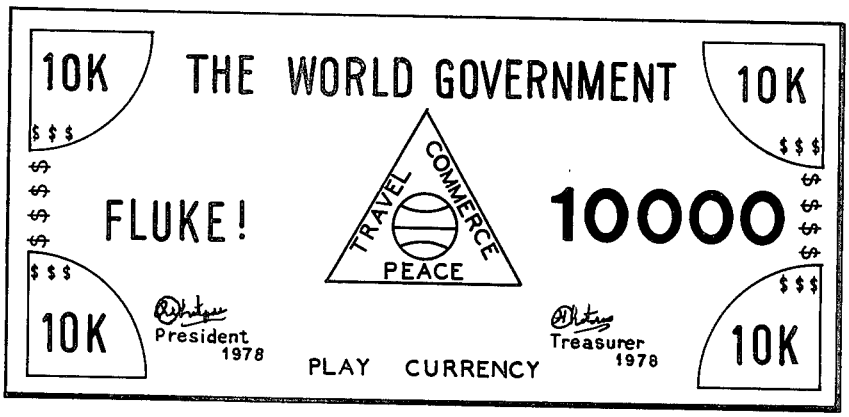
FIG. 7 is an illustration of the typical type of currency or monetary tender which may be employed in playing the game of this invention.

All the buying and selling of commodities requires a monetary tender, which is issued by the World Government. The play money is available in the denominations of $10,000, $5,000, $1,000, $500, $100 and $50 as illustrated in FIG. 7.

Figure 8:
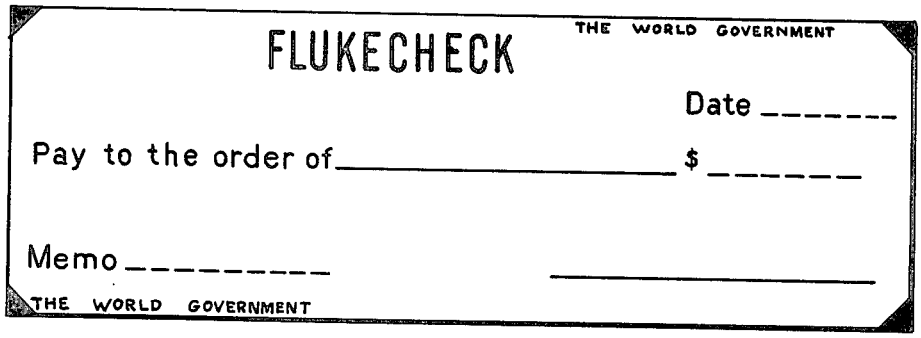
FIG. 8 is an illustration of the typical form of a check which may be employed in playing the game of the invention.

In case one falls short of cash while under the command of the die to buy any commodity or to pay tax, one may write a check in the required amount to another player or the Treasury. FIG. 8 illustrates a sample check which may be called the "FLUKECHECK".

A tabulated card, called "PRICE CARD", is provided to all the players for their convenience. It shows the face prices of all commodities; their market prices corresponding to all price indices; and the total sum to be paid or received depending on the number of units bought or sold at that market price.

START OF GAME

At the outset, the closing time of the game is decided by the players. A Treasurer is then selected by the roll of the Quantity Die 29 with each player successively taking a turn in a clockwise direction. The player rolling the highest number becomes the Treasurer who plays the game as others and also runs the Treasury, for which he receives a one-time salary of $5,000 at the beginning of the game. Each player is given a starting capital of $25,000 in the form of play money, a check book and a price card.

All of the thirty-six disks 14 are placed randomly on the circles 11 of the game board 10 with the colored sides up. The play then starts by the Treasurer rolling the commodity die 30 alone. At this time the other dice are not used. Let us assume that on the roll, the color or indicia gold appears on the top face of the die. The Treasurer then picks any gold colored disk from the game board and examines its under or rear face. If there is no number on the disk, it means the player did not find anything in that area of the world. In that case, he passes the die to the next player. If, however, a player does find a number on the disk, he must buy that many units of the same commodity, in this instance gold, at face price. For example, if the disk has a number 5, the player is authorized and must buy five units 16 of gold at the face price of $1,500 per unit. He, therefore, pays $7,500 to the Treasury and receives five units of gold. He should also examine the letter on the disk and that on the circle. Should they match, he is entitled to purchase those units at half price. However, if such a match occurs on a numberless disk, it is useless. After purchasing the commodity, the player keeps the disk in front of him. The die is passed to the next player and the buying of commodities continues player by player until all the units of all the commodities are bought and there are no more disks on the board. The board is then put aside and is not again used in the game.

At this point, all players are to examine the letters (including the exclamation mark) on their disks in an effort to form one or more separate words from these characters. It is to be noted that the exclamation mark can be used as any letter of the alphabet to form a word. For every word constructed, the player gets a reward of $3000 from the Treasury. There is a special prize of $10,000 for forming the word "FLUKE!". The use of the disks is now over, so they may be returned to the Treasury.

THE SECOND PROCEDURE

The players now possess the various commodities and are prepared to wheel and deal. This takes place as follows. The Treasurer spins the Fluke Wheel 22 for establishing the market prices. For this purpose, the various commodities on the wheel should line up with one of the six sections 27 on the back plate 24-1, 2, ½, 2, 3, and 2. After every two rounds of play, the wheel 22 is spun again. For example, the market price of gold unit 16 from the Fluke Wheel 22, in position of FIG. 2, is $1500 (the face price of gold) multiplied by 2 (the Price Index) or $3000 per unit 16. Thus, the market prices of oil unit and timber unit would be $1600 and $400, respectively.

Copper units 19 have a market price of $1800 but silver units 17 would have a market price of $500 (one-half the face price of $1000).

THIRD PROCEDURE

BUY

The game is played in the clockwise direction. The player next to the Treasurer starts by rolling all the three dice. Let us assume his throw results in the Command Die 28 showing BUY, the Commodity Die 30 showing gold color representing gold and the Quantity Die 29 showing 4 UNITS. This means that he is required to buy from the next player or players 4 units of gold at the then prevailing market price. He buys these four units of gold from the next player whoever has them. Should the next player have only three units of gold, then the buyer buys those and goes further to the next player in line possessing at least one unit of gold. These players must sell to the buyer. In this instance, the buyer pays a total of $12,000 for the four units of gold, as dictated by the Fluke Wheel. See FIG. 2. If a player is short of cash, when required to buy, he must sell all his commodities by auction as explained under item "SELL" below. If even after doing so, he is still short of cash, then he may write checks to others in order to meet the balance of his financial obligations. If a buyer wants to participate in an auction in order to buy commodities, his bids must not exceed the total cash he has. The Treasury fines $500 for such an unauthorized bid and the auction goes on without the disqualified buyer.

SELL

A player must sell, if the Command Die 28 falls with the "SELL" side showing up. The other two dice indicate the commodity and the number of units of that commodity to be sold. If the Price Index is ½ or 1, the player must sell that commodity at that market price to the next player and the latter must buy it. No auctioning is allowed in this case. If, however, the Price Index is 2 or 3 the player required to sell must auction that commodity. This auction is open to all other players and no bidding is allowed below the market price. If nobody bids, the player next to the seller must buy those units from him at the market price. As mentioned above, players' bids cannot exceed the cash that they have and NO checks are allowed in auction.

TAX

In case the roll of the three dice results in the Command Die 28 showing TAX and the Quanity Die 29 shows 4 UNITS, a payment must be made to the Treasury of 4 times 1000 or $4000. The Commodity Die 30 is not considered in this case. Should 6 UNITS appear on the Quantity Die, then $6000 must be paid. In other words, the number of units indicated by the Quantity Die multiplied by 1000 determines the amount to be paid.

TAX RETURN

In the event of the Command Die 28 showing "TAX RETURN", the player receives from the Treasury an amount equal to the number of units on the Quantity Die multiplied by 1000. For example, a throw of 5 UNITS on the Quanity Die 29 in conjunction with the "TAX RETURN" command entitles a player to receive $5000.

The above Third Procedure continues from player to player until the predetermined time of play has expired.

FINAL PROCEDURE (called The "GRAND FLUKE")

At the time of closing the game, the Treasurer gives the Fluke Wheel 22 a final spin for determining the final market prices of the several commodities. As noted above, the market price is obtained by multiplying the face price of the commodity appearing on the wheel by the figure appearing in the adjacent section, namely the Price Index 27. The Treasury then buys back from all players all of their commodities at the final market price. All players count their money and report the amount of cash to the Treasurer and present to him the checks they have received. He then substracts the amount written in the checks from the total cash of the writer of the check and adds it to the cash of the receiver of the check. In addition, the Treasury charges a handling fee of $500 per check to the writer of the checks. The player who has the most money, is the winner.

It should be mentioned that the auction specified under "Sell" in the Third Procedure, may be omitted when playing with children, so as to somewhat simplify the game. In such an event, the player sells his commodity to the next adjacent player.

Although I have described the preferred form of the invention, it is to be understood that changes in details of procedure and devices employed may be made without departing from the invention, especially as defined in the appended claims.

What we claim:

1. A game involving the acquiring and selling of commodities comprising:

(a) a game board having a plurality of regions for commodities;

(b) sets of game pieces to be placed randomly on said regions, each set directed to and coded for a specific commmodity and selected pieces bearing numbers on their inner faces;

(c) a commodity die having indicia on the respective faces for each set of commodities, whereby a roll determines a particular commodity to be bought or sold by a player;

(d) a plurality of different commodity units corresponding to said game pieces each unit displaying the face price of that commodity, such units being purchased at such face price by players successively in response to a roll of the command die which then indicates the commodity unit to be purchased and the game piece selected by the player determining from the number displayed, the number of units he must buy;

(e) a market price determining device movable for establishing the market price of each unit, said device comprising a rotatable wheel having a row of face price displaying commodity labels adapted upon rotation to line up with stationary row of numbers, the market price being calculated by multiplying the face price of a commodity by a number adjacent thereto;

(f) a quantity die having 1 to 6 units marked respectively on its faces;

(g) a command die having indicia on its face to require buying/selling or impose a penalty or to provide financial benefit, the commodity die, the quantity die and the command die being thrown together by the players successively.

2. A game according to claim 1 in which said row of commodity labels are equidistantly spaced, and a back plate extending beyond the periphery of said wheel and on which the latter rotates, and sections marked off the extending portion of said back plate for the commodities, respectively, and containing said numbers.

3. A game according to claim 2 wherein said labels pivotally affixed to said wheel.

4. A game according to claim 1 in which certain of the regions of the game board contain indicia, and certain of the game pieces contain similar indicia on the rear face, any matching of said indicia enables a player to purchase the designated commodity units at one-half price.

5. A game according to claim 1 wherein said command die bears indicia on all of its faces directing players to a specific activity of buying, selling, paying penalties, or receiving rewards.

6. A game according to claim 1 including the inclusion of a plurality of checks transferrable between players, a computation indices showing calculation of arithematic computations paid or received in the buying and selling transactions, and a quantity of indicia containing members simulating currency.

* * * * *